US009994380B1

(12) United States Patent
Szeremeta et al.

(10) Patent No.: US 9,994,380 B1
(45) Date of Patent: Jun. 12, 2018

(54) RUGGEDIZED ENCLOSURE FOR DATA STORAGE DEVICE

(75) Inventors: Wojciech Szeremeta, Mission Viejo, CA (US); Brian S. Nihei, Fountain Valley, CA (US); Steven T. Peng, Irvine, CA (US)

(73) Assignee: WESTERN DIGITAL TECHNOLOGIES, INC., Irvine, CA (US)

( * ) Notice: Subject to any disclaimer, the term of this patent is extended or adjusted under 35 U.S.C. 154(b) by 564 days.

(21) Appl. No.: 13/308,410

(22) Filed: Nov. 30, 2011

(51) Int. Cl.
*B65D 85/00* (2006.01)
*B65D 81/127* (2006.01)
*B65D 81/05* (2006.01)

(52) U.S. Cl.
CPC ..... *B65D 81/127* (2013.01); *B65D 81/05* (2013.01); *B65D 81/051* (2013.01)

(58) Field of Classification Search
CPC .... B65D 81/05; B65D 81/051; B65D 81/052; B65D 81/053; B65D 81/054; B65D 81/055; B65D 81/056; B65D 81/057; B65D 81/058; B65D 81/127
USPC ..... 206/320, 523, 586, 576, 591, 592, 594, 206/305, 701
See application file for complete search history.

(56) References Cited

U.S. PATENT DOCUMENTS 3,016,177 A 1/1962 Chaplin
3,167,322 A 1/1965 Aichroth
3,710,733 A * 1/1973 Story ..... 108/57.28
3,938,661 A 2/1976 Carmody
4,158,757 A 6/1979 Reichert et al.
D268,380 S 3/1983 Thiele
4,854,476 A 8/1989 Serio, Jr.
4,866,934 A 9/1989 Lindstedt
4,910,882 A 3/1990 Goller
D309,832 S 8/1990 Hung
5,045,636 A 9/1991 Johnasen et al.
5,088,084 A 2/1992 Komiya et al.
5,117,952 A * 6/1992 Suh ..... 190/127
5,223,996 A 6/1993 Read
5,293,282 A 3/1994 Squires et al.
5,422,766 A 6/1995 Hack et al.
5,491,608 A * 2/1996 Koyanagi et al. ..... 361/679.34
5,535,092 A 7/1996 Bang
5,641,068 A 6/1997 Warner
5,703,734 A 12/1997 Berberich
5,793,566 A 8/1998 Scura
(Continued)

OTHER PUBLICATIONS

Office Action dated Nov. 27, 2012 from U.S. Appl. No. 13/430,455, 13 pages.

(Continued)

*Primary Examiner* — Andrew Perreault
(74) *Attorney, Agent, or Firm* — Knobbe, Martens, Olson & Bear, LLP

(57) ABSTRACT

The embodiments provide a rugged enclosure for an external drive. The enclosure is configured to provide shock protection and protect the external drive from contaminants. The enclosure may be provided with a set of cushions and spacers to accommodate different sizes and types of external drives. In addition, the enclosure may comprise a port that allows for use of the external drive while enclosed. Furthermore, the enclosure may comprise a retaining feature like a loop or lanyard that allows the enclosure to be easily transported and secured.

21 Claims, 7 Drawing Sheets

(56) References Cited

U.S. PATENT DOCUMENTS

| | | | | |
|---|---|---|---|---|
| D405,957 | S | 2/1999 | Test | |
| D419,297 | S | 1/2000 | Richardson et al. | |
| D422,573 | S | 4/2000 | Takano et al. | |
| 6,073,770 | A * | 6/2000 | Park | 206/522 |
| D436,958 | S | 1/2001 | Chen et al. | |
| 6,222,727 | B1 | 4/2001 | Wu | |
| D446,650 | S | 8/2001 | Chen | |
| 6,347,021 | B2 | 2/2002 | Kazmierczak et al. | |
| 6,460,859 | B1 | 10/2002 | Hammi et al. | |
| D471,911 | S | 3/2003 | Takiguchi et al. | |
| 6,739,452 | B2 | 5/2004 | Rochelo | |
| 6,749,446 | B2 | 6/2004 | Nechitailo | |
| 6,840,381 | B2 | 1/2005 | Stephens | |
| 6,845,006 | B2 | 1/2005 | Kobayashi | |
| D502,316 | S | 3/2005 | Chen | |
| 6,891,723 | B1 | 5/2005 | Lin et al. | |
| 6,896,134 | B2 | 5/2005 | Russell et al. | |
| D506,064 | S | 6/2005 | Keegan et al. | |
| D511,774 | S | 11/2005 | Tanio | |
| 6,968,954 | B2 * | 11/2005 | Hsieh | 206/587 |
| 6,969,548 | B1 | 11/2005 | Goldfine | |
| D516,807 | S | 3/2006 | Richardson | |
| D517,317 | S | 3/2006 | Singh | |
| D532,785 | S | 11/2006 | Lo et al. | |
| D534,909 | S | 1/2007 | Weiher et al. | |
| D548,971 | S | 8/2007 | Lin | |
| D555,357 | S | 11/2007 | Hsieh | |
| 7,306,159 | B1 | 12/2007 | Rochelo | |
| D565,298 | S | 4/2008 | Braun | |
| 7,362,541 | B2 | 4/2008 | Bernett | |
| D569,616 | S | 5/2008 | Lin | |
| 7,430,116 | B2 | 9/2008 | Liu | |
| 7,475,816 | B1 | 1/2009 | Rochelo | |
| D587,267 | S | 2/2009 | Wang | |
| 7,500,561 | B2 * | 3/2009 | Matias et al. | 206/320 |
| 7,520,389 | B2 * | 4/2009 | Lalouette | 206/722 |
| 7,584,851 | B2 | 9/2009 | Hong et al. | |
| D609,701 | S | 2/2010 | Hou | |
| 7,701,705 | B1 | 4/2010 | Szeremeta | |
| D617,557 | S | 6/2010 | Molina et al. | |
| 7,810,639 | B2 | 10/2010 | Djulaini et al. | |
| 7,886,903 | B1 * | 2/2011 | Wurzelbacher et al. | 206/320 |
| D645,251 | S | 9/2011 | Lee | |
| D646,272 | S | 10/2011 | Woo et al. | |
| 8,064,194 | B2 | 11/2011 | Szeremeta | |
| 8,113,873 | B1 | 2/2012 | Sarraf | |
| 8,133,426 | B1 | 3/2012 | Yurchenco et al. | |
| D668,866 | S | 10/2012 | Meng | |
| D674,393 | S | 1/2013 | Behar | |
| 8,358,395 | B1 | 1/2013 | Szeremeta | |
| D677,464 | S | 3/2013 | Taylor | |
| 8,417,979 | B2 | 4/2013 | Maroney | |
| 8,462,460 | B1 | 6/2013 | Szeremeta et al. | |
| 8,498,088 | B1 | 7/2013 | Klein | |
| 8,547,658 | B1 | 10/2013 | Szeremeta | |
| D694,759 | S | 12/2013 | Chang | |
| D729,520 | S | 5/2015 | Koeniger | |
| D740,809 | S | 10/2015 | Kwon | |
| D749,846 | S | 2/2016 | Koeniger | |
| D753,917 | S | 4/2016 | Koeniger | |
| D758,065 | S | 6/2016 | Zwetzig | |
| D795,874 | S | 8/2017 | Szeremeta et al. | |
| 2002/0114104 | A1 | 8/2002 | Hearn et al. | |
| 2005/0115860 | A1 * | 6/2005 | Mertz et al. | 206/521 |
| 2005/0150961 | A1 | 7/2005 | Porter | |
| 2006/0076253 | A1 | 4/2006 | Hong et al. | |
| 2006/0087763 | A1 | 4/2006 | Chua et al. | |
| 2006/0158775 | A1 | 7/2006 | Sega et al. | |
| 2008/0062636 | A1 | 3/2008 | Liu | |
| 2009/0009945 | A1 * | 1/2009 | Johnson et al. | 361/681 |
| 2009/0161309 | A1 | 6/2009 | Yang | |
| 2010/0238623 | A1 | 9/2010 | Pan | |
| 2011/0057392 | A1 | 3/2011 | Monnet et al. | |
| 2013/0062468 | A1 | 3/2013 | Yokoi | |

OTHER PUBLICATIONS

Office Action dated Feb. 6, 2013 from U.S. Appl. No. 13/430,455, 7 pages.

Interview Summary dated Apr. 4, 2013 from U.S. Appl. No. 13/430,455, 3 pages.

Final Office Action dated Apr. 16, 2014 from U.S. Appl. No. 13/308,423, 15 pages.

Office Action dated Jul. 12, 2013 from U.S. Appl. No. 13/430,455, 14 pages.

Final Office Action dated Nov. 7, 2013 from U.S. Appl. No. 13/430,455, 9 pages.

Advisory Action dated Jan. 22, 2014 from U.S. Appl. No. 13/430,455, 3 pages.

Office Action dated Dec. 23, 2013 from U.S. Appl. No. 13/308,423, 29 pages.

Office Action dated Jun. 26, 2014 from U.S. Appl. No. 13/430,455, 26 pages.

Advisory Action dated Jul. 3, 2014 from U.S. Appl. No. 13/308,423, 3 pages.

U.S. Appl. No. 29/613,711, filed Dec. 23, 2015, Szeremeta, et al.

Western Digital Nomad im Hartetest a la Caschy. stadt-bremerhaven.de. (online) 7 pgs. Posted Sep. 2011. [retrieved on Jan. 8, 2017] http://stadt-bremerhaven.de/western-digital-nomad-im-haertetest-a-la-caschy-video-inside/.

WO Nomad Rugged Case. amazon.com. (Online Image) 1 pg. By Margie on Aug 10, 2012. [retrieved on Jan. 8, 2017] https://www.amazon.com/Western-Digital-WDBGRDOOOONBK-NASN-Nomad-Rugged/dp/B00505EZZ6.

WO Nomad Rugged Case. amazon.com. (Online Image) 1 pg. Posted by Jay115 "Jay" Mar. 14, 2013. [retrieved on Jan. 8, 2017] https://www.amazon.com/Western-Digital-WDBGRDOOOONBK-NASN-Nomad-Rugged/dp/B00505EZZ6.

* cited by examiner

RUGGEDIZED ENCLOSURE FOR DATA STORAGE DEVICE

CROSS REFERENCE TO RELATED APPLICATIONS

This application is related to U.S. patent application Ser. No. 13/308,423, entitled "SELF RETAINING ELASTOMERIC SEAL," filed on Nov. 30, 2011, which is incorporated by reference herein in its entirety.

BACKGROUND

High capacity, portable external disk drives have become a popular device. Today, users can transport and use a large amount of data, such as data files, documents, music, etc., with them. Portable external drives give a user the flexibility to easily carry and transport their data. Modern external drives have a relatively small physical size and yet they allow storing data capacities approaching of a terabyte or more.

For example, professional photographers may elect to use a portable external disk drive as an information storage device in the field to store pictures or movies. As another example, portable external disk drives are used to carry multimedia files, such as movies. In such applications, the robustness of the external drive can be a critical requirement.

However, portable external disk drives typically include sensitive components, such as electronics and delicate mechanical components. In particular, hard disk drives are vulnerable to excessive shock and vibration, which are common to a mobile environment. When mobile, a hard disk drive's internal components can be damaged if it is dropped, struck, or bounced, especially against a hard surface. The user may be unaware of the damage since the damage to the external drive can occur even without visible external damage. For example, if a portable disk drive is dropped, contact with a hard surface may lift the slider of the disk surface and then slap back on the disk surface creating damage. A disk drive that is subjected to this type of shock may fail on initial use or the reliability of the drive may degrade over time. Furthermore, when used in a mobile environment, external drives may be exposed to excessive moisture or dust conditions that can also damage or degrade components.

BRIEF DESCRIPTION OF THE DRAWINGS

Systems and methods which embody the various features of the invention will now be described with reference to the following drawings, in which.

DETAILED DESCRIPTION

Figure 1:
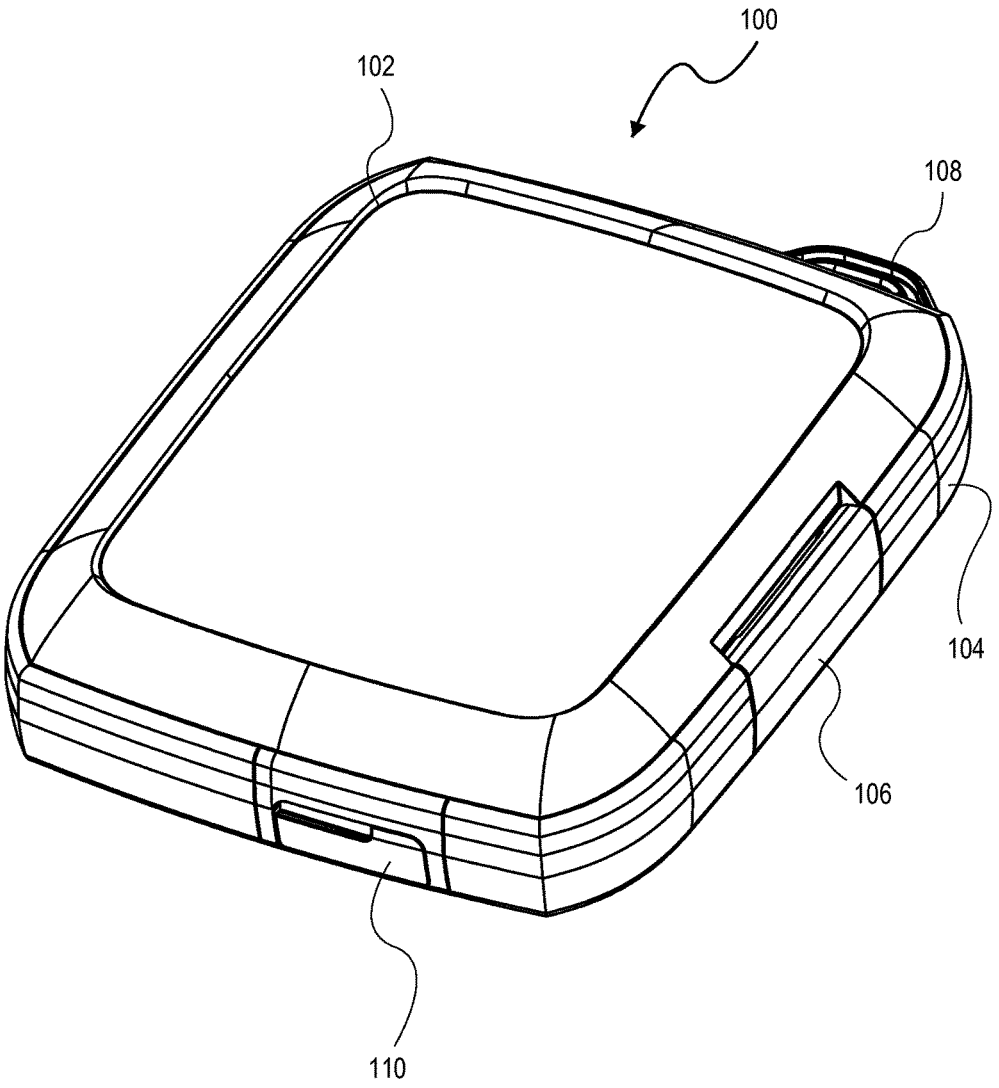
FIG. 1 shows an exemplary embodiment of a ruggedized enclosure for an external drive, such as a portable disk drive.

The embodiments relate to providing a rugged enclosure for an external drive, such as a portable disk drive. The rugged enclosure provides protection from shock and vibration, moisture, and contaminants. The rugged enclosure may thus prevent the external drive from short-term, traumatic damage as well as long-term, chronic damage caused by exposure to an external environment and mobile usage. Unlike known cases for portable disk drives, the embodiments provide a rugged enclosure that is capable of providing higher levels of protection, for example, that conform to known military and industrial standards.

The rugged enclosure provides cushioning and a sway space in order to tolerate shock, such as from a drop from various heights. In the embodiments, the cushioning of the rugged enclosure may be generally positioned on the perimeter of the casing of a data storage device. For example, as shown in the figures, the cushions are generally placed on either longitudinal portion of an external drive. This placement was found to take advantage of the stronger and stiffer portions of the casing of the data storage device. In addition, this perimeter placement helps avoid excessive pinching of the casing in its central portions, where the casing tends to be more flexible and prone to damage. Excessive pinching in the central portion may cause substantial damage, for example, to the disk drive components. However, in order to also preserve portability of the external drive, the rugged enclosure is configured with a low profile form factor that is relatively compact. Accordingly, in some embodiments, the rugged enclosure employs a low profile hinge and low profile latch to maintain its small size.

In addition, in the embodiments, the rugged enclosure may be fitted with different cushions or other components to accommodate different sizes and types of external drives. This allows the ruggedized enclosure to fit a wide variety of external drive models and types. The rugged enclosure can thus provide a range of protection for drives having different sizes, weights, etc.

To minimize the need for opening, the ruggedized enclosure may also comprise a port that allows use of the external drive while enclosed in the enclosure. This port may provide a physical passage to the drive within the enclosure, or in the alternative, the port may provide an external interface that is electrically coupled to the drive. For purposes of illustration, the embodiments shown in the disclosure illustrate a rugged enclosure for an external drive that utilizes a universal serial bus (USB) interface. However, other embodiments of the rugged enclosure may be used for other types of data storage drives. For example, the rugged enclosure may be configured to enclose any type of drive, such as a hard disk drive. In these configurations, the rugged enclosure may be fitted with additional components, such as a bridge circuit or bridge controller, to allow for communications with the typical SATA interface of a hard disk drive. In yet other embodiments, the rugged enclosure may also accommodate solid state drives, hybrid drives, etc.

Certain embodiments of the inventions will now be described. These embodiments are presented by way of example only, and are not intended to limit the scope of the inventions. For purposes of illustration, the enclosure is shown for use with an external disk drive. Indeed, the novel methods and systems described herein may be embodied in a variety of other forms. However, one skilled in the art will appreciate that the enclosure may be used with any type of external drive. Furthermore, various omissions, substitutions and changes in the form of the methods and systems described herein may be made without departing from the spirit of the inventions. To illustrate some of the embodiments, reference will now be made to the figures.

FIG. 1 shows an exemplary embodiment of a ruggedized enclosure 100. In general, the ruggedized enclosure 100 shown is designed to robustly protect any type of external drive, such as a portable disk drive, and allows for use of the storage device even while enclosed. The ruggedized enclosure 100 may be constructed from various materials, such as a thermoplastic, carbon fiber, metal, metal alloy, or combination thereof, to protect the enclosed drive and protect the device from exposure to a mobile environment having moisture, dust, and other contaminants. Furthermore, the ruggedized enclosure 100 may be configured to protect a portable disk drive from various levels of shock, such as a drop from 1-2 feet, 2-4 feet, 4-8 feet, etc.

In some embodiments, the ruggedized enclosure 100 is configured to comply with various shock and vibration standards. For example, in one embodiment, the ruggedized enclosure 100 complies with the MIL-STD and/or ISO standards for shock and vibration. For example, the embodiments may be configured to comply with various aspects of MIL-STD 810.

In some embodiments, the ruggedized enclosure 100 may withstand shock levels equivalent to a free-fall of about seven to eight feet for a free-fall drop on to a hard surface, such as an industrial carpet surface, concrete, asphalt, a floor, counter top, a wood surface, or other type of hard surface. In addition, the ruggedized enclosure 100 may be relatively water-resistant, for example, a spill of water or other fluid while protecting an enclosed external drive. In yet other embodiments, the ruggedized enclosure 100 may be configured to be relatively water-tight or water-proof, such that the enclosure 100 can be partially or fully submerged in a liquid.

Furthermore, as noted above, the ruggedized enclosure 100 may be configured to prevent dust or other airborne contaminants. Indeed, the ruggedized enclosure 100 may comprise various seals capable of preventing dust from entering its internal space when enclosed as well as filtering elements.

As shown, the ruggedized enclosure 100 may comprise an upper portion, cover 102, a lower portion, bottom 104, a latch 106, a retaining feature 108, and a port 110. As to dimension, the ruggedized enclosure 100 may be generally about 5.5 inches in length, 4.5 inches in width, and 1.5 inches in height. That is, the rugged enclosure 100 may generally have a size and shape that is relatively close fitting and low profile in nature to enhance the portability of the enclosure. Of course, these dimensions may vary depending on the desired data storage devices or external drives to be enclosed. These components will now be further described.

The cover 102 serves as a top portion enclosing the ruggedized enclosure 100. The cover 102 may be coupled to the bottom 104 of the ruggedized enclosure 100 via various mechanisms, such as a hinge (not shown in FIG. 1). In order to minimize the size of the ruggedized enclosure 100, the hinge may have a low profile and be constructed so as not to protrude beyond the overall form factor of the ruggedized enclosure 100. In particular, the hinge may employ a barrel that is located internally to the form factor of the rugged enclosure 100. The design of the barrel was configured in order to provide for sufficient opening of the enclosure 100. The internal location of the barrel for the hinge was also found to protect it from exposure and damage. Of course, in other embodiments, the ruggedized enclosure 100 may employ a hinge having a conventional, external barrel. In the embodiment shown, the cover 102 is attached to the bottom 104 with a low profile, flat hinge (shown at reference 324 in FIG. 3), e.g., a hinge having an internally located barrel. In other embodiments, the cover 102 may be detachable from the bottom 104, for example, using a fastener, a strap, etc. For example, the cover 102 may employ dual latches or fasteners so that it is completely detachable from the bottom 104.

As shown in FIG. 1, the cover 102 is constructed from an opaque material that is relatively rigid sufficient to protect a portable disk drive from mechanical shock and exposure, such as a thermoplastic or metal alloy. In other embodiments, the cover 102 may comprise various features, such as a transparent portion to allow viewing of the interior of the ruggedized enclosure 100, or a display, such as a liquid crystal display or electronic ink display. Furthermore, the cover 102 may comprise one or more identification spaces to allow a user to label the ruggedized enclosure 100 and indicate any contents enclosed.

The bottom 104 provides a corresponding portion to the cover 102 to provide a protected enclosed space to hold a portable disk drive. The bottom 104 may be constructed from the same or different materials as the cover 102. Like the cover 102, the bottom 104 may simply be opaque or may comprise various features, such as a transparent portion to allow viewing of the interior of the ruggedized enclosure, or a display, such as a liquid crystal display or electronic ink display. Furthermore, the bottom 104 may comprise one or more identification spaces to allow a user to label the ruggedized bottom 104 and indicate any contents enclosed.

The latch 106 provides a mechanism for closing and sealing the ruggedized enclosure 100 when in its closed configuration. As shown, the latch 106 is configured as a flat tongue-like piece that does not protrude beyond the overall form factor of the ruggedized enclosure 100. In other embodiments, the ruggedized enclosure 100 may be held in its closed configuration with other mechanisms, such as a fastener, slider, twist lock, cam lock, etc. In some embodiments, the latch 106 is configured to provide approximately 20-30 Newtons of closing force to maintain the enclosure in its closed configuration even during shock conditions.

The retaining feature 108 is an optional feature that allows the ruggedized enclosure 100 to be attached or retained to another device or item. For example, as shown in FIG. 1, the retaining feature 108 is a loop or utility hook. In other embodiments, the retaining feature 108 may be a mechanism, such as a hook, a lanyard, etc.

The port 110 provides a passage for allowing access to a portable disk drive while enclosed. As shown, the port 110 may comprise a sealing mechanism, such as a door, or slider that allows for passage of a cable, such as a Universal Serial Bus (USB) cable. In the embodiment shown, the port 110 provides for a physical passage into the interior of the ruggedized enclosure.

In other embodiments, rather than a mechanical opening or passage, the port 110 may be configured as an electrical connector that preserves the mechanical integrity of the ruggedized enclosure 100. For example, the port 110 may be a male or female USB connector that is then electrically coupled to a portable disk drive while inside the enclosure 100.

Figure 2:
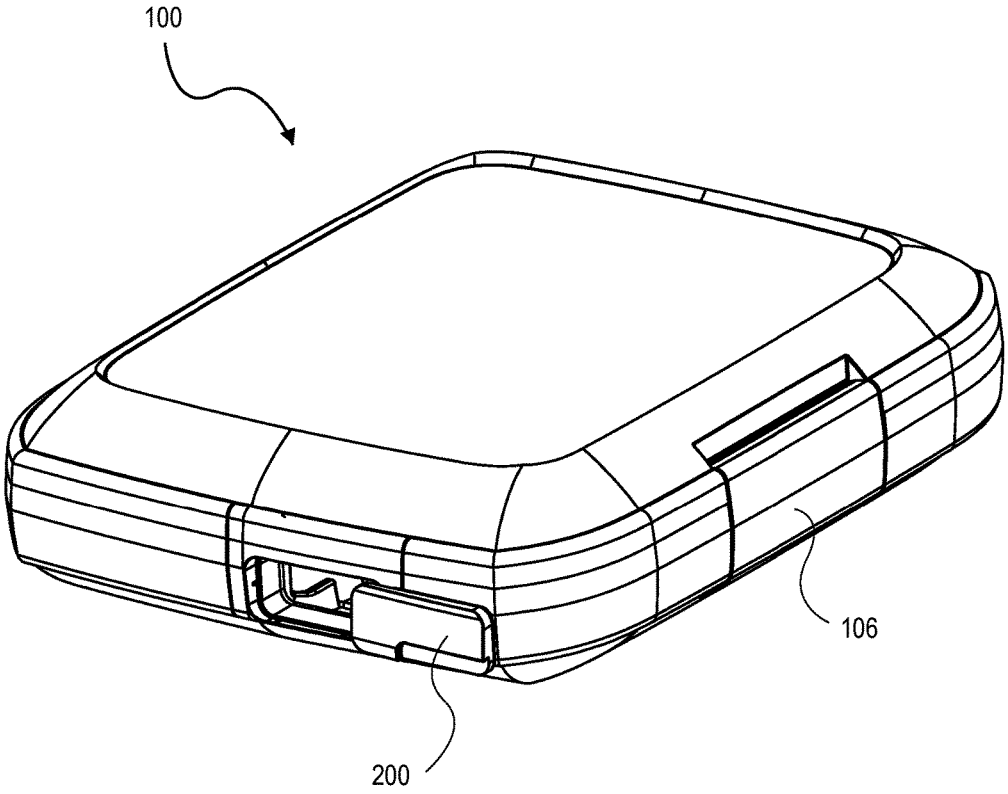
FIG. 2 shows another view of the ruggedized enclosure and a port on the enclosure.

FIG. 2 shows another view of the ruggedized enclosure 110 and the port 110 on the enclosure. As shown, the port 110 comprises a sliding door 200 that can be retracted and rotated to allow for passage of a USB cable. This feature allows for use of a portable disk drive while enclosed in the ruggedized enclosure. Furthermore, the ruggedized enclosure 100 may comprise a plurality of ports or different types of ports to accommodate different disk drives, devices, or cabling. The ruggedized enclosure 100 may also comprise various components, such as bridge circuits or bridge controllers, to accommodate a variety of interfaces to different types of disk drives or data storage devices.

In one embodiment, the sliding door 200 is constructed from a compliant material, such as an elastomer or rubber, to allow for easy handling by a user and to provide a sealing structure for port 110. As shown, the sliding door 200 may be shaped as a tab-like structure to cover the port 110. In other embodiments, the sliding door 200 may comprise different shapes, such as oval, circular, triangular, etc.

In yet other embodiments, sliding door 200 may comprise other features. For example, the sliding door 200 may be self-latching when covering port 110. The sliding door 200 may also comprise a locking feature to prevent unauthorized or unintentional opening or removal. Furthermore, the sliding door 200 may be constructed from different materials, such as metal, plastic, or combination thereof, to provide rugged protection for port 110.

Figure 3:
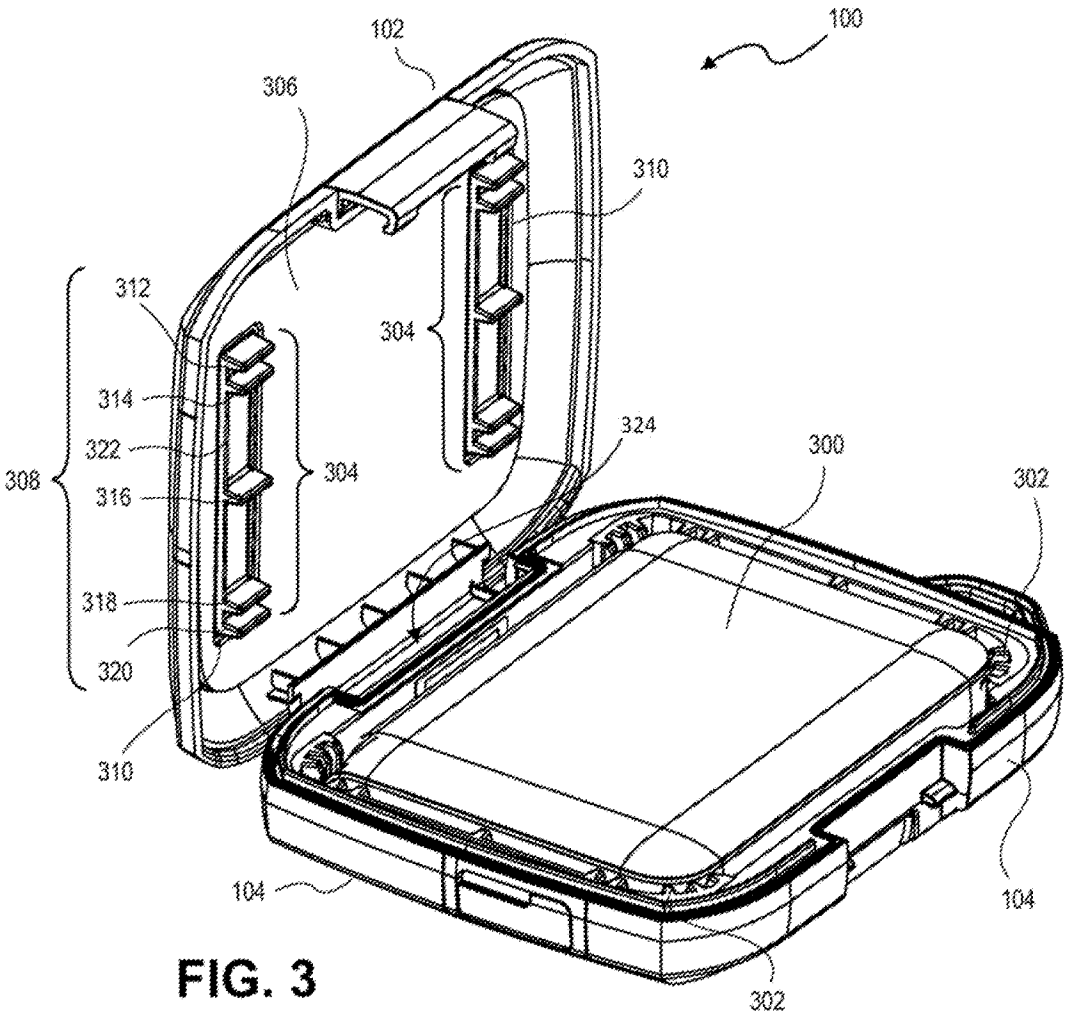
FIG. 3 shows an open ruggedized enclosure of FIG. 1 containing a portable external drive.

FIG. 3 shows an open ruggedized enclosure of FIG. 1 containing a portable disk drive 300. As can be seen, the portable disk drive 300 may be held in the bottom portion 104 and secured in place with cushions 302. Furthermore, the cover 102 may also comprise a set of cushion assemblies 304 and an upper padding 306 to assist in protecting the portable disk drive 300 from shock, etc. Cushion assemblies 304 may comprise cushions 308 and a spacer 310. These components will now be further described below.

Cushions 302, 308 and upper padding 306 may be constructed from various materials, such as an elastomeric material or a foam-like material. In addition, cushions 302, 308 and upper padding 306 may vary in material, size, thickness, and shape to accommodate different sizes of portable devices or different types of portables drives. For example, a kit or package of such cushions that are customized to a particular portable disk drive 300 may be provided with the ruggedized enclosure 100.

In order to allow the enclosure 100 to accommodate different drives, the cushion assembly 304 may comprise the cushion 308 and an optional spacer 310. For example, the cushion assembly 304 may be modular in construction to allow for different spacers 310 and/or cushions 308. This feature allows the enclosure 100 to be fitted with different configurations of cushions, cushion heights, and cushion geometry to enclose and protect the drive 300.

As shown, the cushions 308 may have a strip-like structure from which rib-like cushioning arms extend. As noted above, the cushions 308 may be constructed from various materials known for their cushioning and shock absorbing properties, such as rubber, foam, or elastomeric material. In general, the cushions 308 are configured to provided a controlled stiffness based on their shape and materials. In the embodiment shown in FIG. 3, the cushions 308 may comprise cushioning arms 312, 314, 316, 318, and 320. In general, the cushioning arms 312, 314, 316, 318, and 320 may have a trapezoidal or conical shape to provide a desired stiffness and cushioning to allow shock energy to be dissipated as well as to withstand various shock conditions without excessive buckling. As to placement, in the embodiment shown, cushioning arms 312, 314, 318, and 320 may be clustered on either end of cushion 308 while cushioning arm 320 may be placed in the middle area of cushion 308. Of course, cushion 308 may employ different spacing and types of cushioning arms.

As also shown, the cushion 308 may comprise a side wall 322 around its perimeter to provide additional structural support for the cushioning arms 312, 314, 318, and 320. The side wall 322 may be included to provide additional support with relatively little extra material needed. In the embodiment shown, the side wall 322 is provided around the perimeter of the cushion 308, but can be provided anywhere. In yet other embodiments, the cushioning arms 312, 314, 318, and 320 may comprise cross-structural features, such as cross beams.

In addition, as can be seen, the cushion assembly 304 is provided on the cover 102 at specific locations that are closer to the edges of the cover 102 in the embodiment shown. For example, in some embodiments, the cushioning assembly 304 is placed within about 1-inch of the edge of the cover and provides approximately 2.5 inches of spacing between them. These locations of the cushioning assembly 304 may be used to prevent pinching in the middle or central portion of the casing of the portable disk drive (not shown) when the ruggedized enclosure 100 is subjected to shock or mechanical pressure, especially when pressure is exerted on the central portions of the top 102 or bottom 104. In other words, the cushions of the rugged enclosure 100 effectively suspend the drive at its perimeter edges and provide further clearance in the central portion of the casing of the drive. As noted, this placement was found to take advantage of the stiffer portions of the casing and avoid the casing in its central portion where it tends to be more flexible and prone to intrusion into the drive components under excessive deflection. As shown in the figures, the cushions suspend the drive at the longitudinal ends of the casing. In other embodiments, the cushions may be placed to fully encircle the casing around its perimeter, or may be placed along the lateral sides of the casing of the drive.

Furthermore, the cushioning assembly 304 is placed so that their shock dampening structures are substantially along the same axis of cushions 302. That is, when closed, the cushioning assembly 304 and cushions 302 are aligned to minimize their offset and provide support along substantially the same axis. This placement provides for a shock dampening structure on both the top and bottom of the drive 300 along the same axis. This placement may be helpful to secure the drive 300 and to prevent moment arms of movement during shock conditions.

Figure 4:
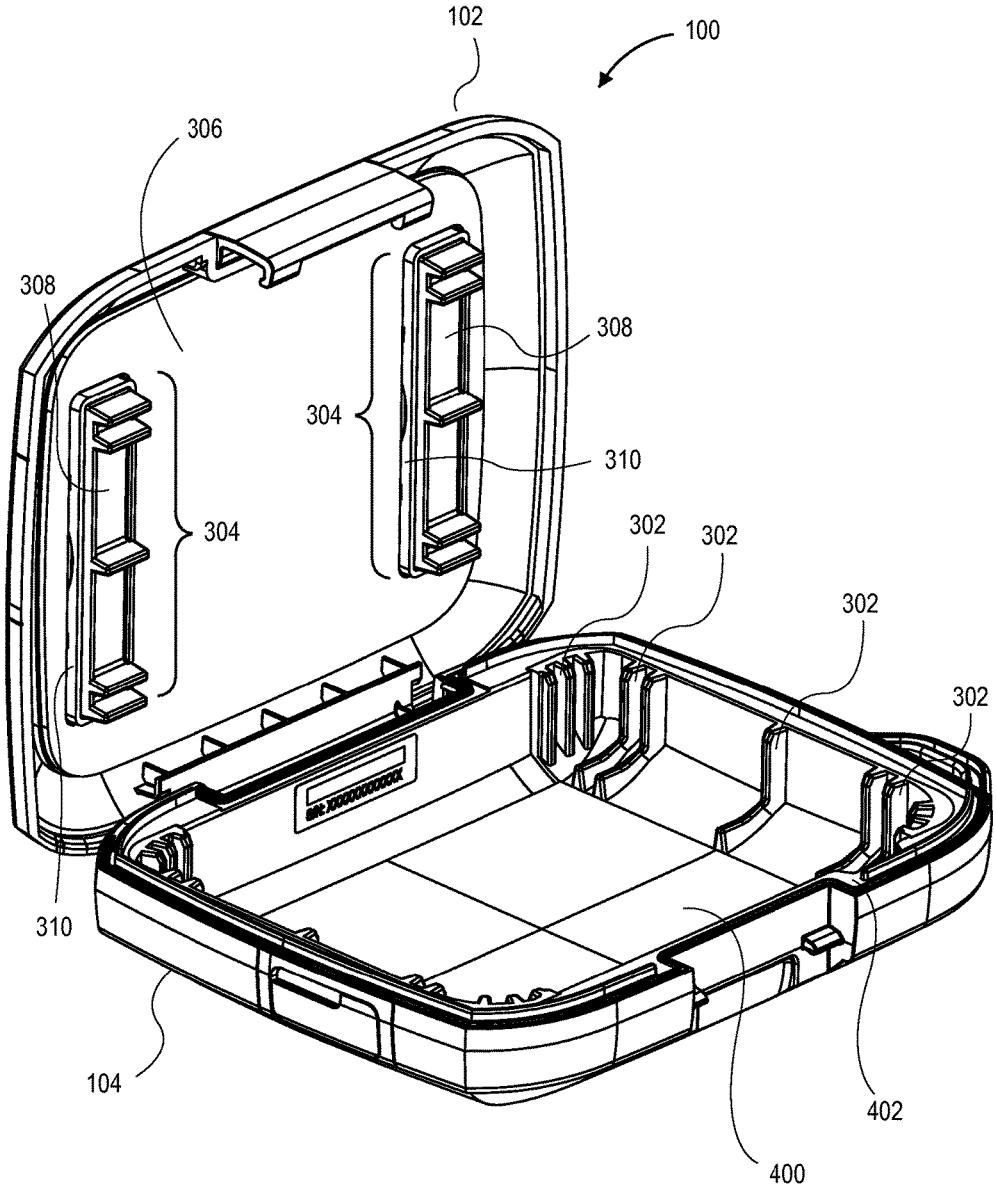
FIG. 4 shows an open ruggedized enclosure of FIG. 1.

FIG. 4 shows the ruggedized enclosure 100 of FIG. 1 in its open configuration. As shown, the bottom 104 may comprise a bottom padding 400 to provide some cushioning as well as for secure holding of a portable disk drive (not shown in FIG. 4). Bottom padding 400 may be constructed from known materials, such as a foam-like material, rubber, or other type of elastomeric material. The shape and thickness of bottom padding 400 may vary depending on the desired drive type and size to be enclosed in the enclosure 100. The top 102 may comprise cushioning assemblies 304 and padding 306. As shown, the cushioning assemblies 304 may again comprise cushions 308 and a spacer 310.

In addition, cushions 302 are shown installed in the bottom 104 at various strategic locations, such as in proximity to the corners to provide shock protection rather than in the central portion of the bottom 104. The configuration and distribution of these cushions may vary depending on the desired amount of protection and the dimensions of the portable disk drive (not shown). As described above, these positions for cushions 302 roughly correspond to the positions of cushioning assemblies 304 in the top 102 in order to secure the drive (not shown) in place and also prevent excessive pinching in the central portion of the drive 300

(not shown in FIG. 4), which may cause intrusion into the drive's components and significant damage.

As also shown, an elastomeric seal 402 may be provided in the bottom 104. The seal 402 provides a seal against moisture, dust, etc., when the ruggedized enclosure 100 is in its closed configuration. In addition, the seal 402 is configured based on its size and shape to provide for a sufficient latching force to hold the enclosure 100 closed, but also allowing for an acceptable level of effort to open the enclosure 100 by a user. In some embodiments, the elastomeric seal 402 is constructed from a plastic or rubber material. Furthermore, in some embodiments the elastomeric seal 402 is self-retaining. That is, the seal 402 does not require a separate fastener or glue to be held into place in the bottom 104. This allows the seal 402 to be easily replaced or changed. For example, related U.S. patent application Ser. No. 13/308,423, entitled "SELF RETAINING ELASTOMERIC SEAL," may be used in the embodiments and is incorporated by reference herein in its entirety.

Figure 5:
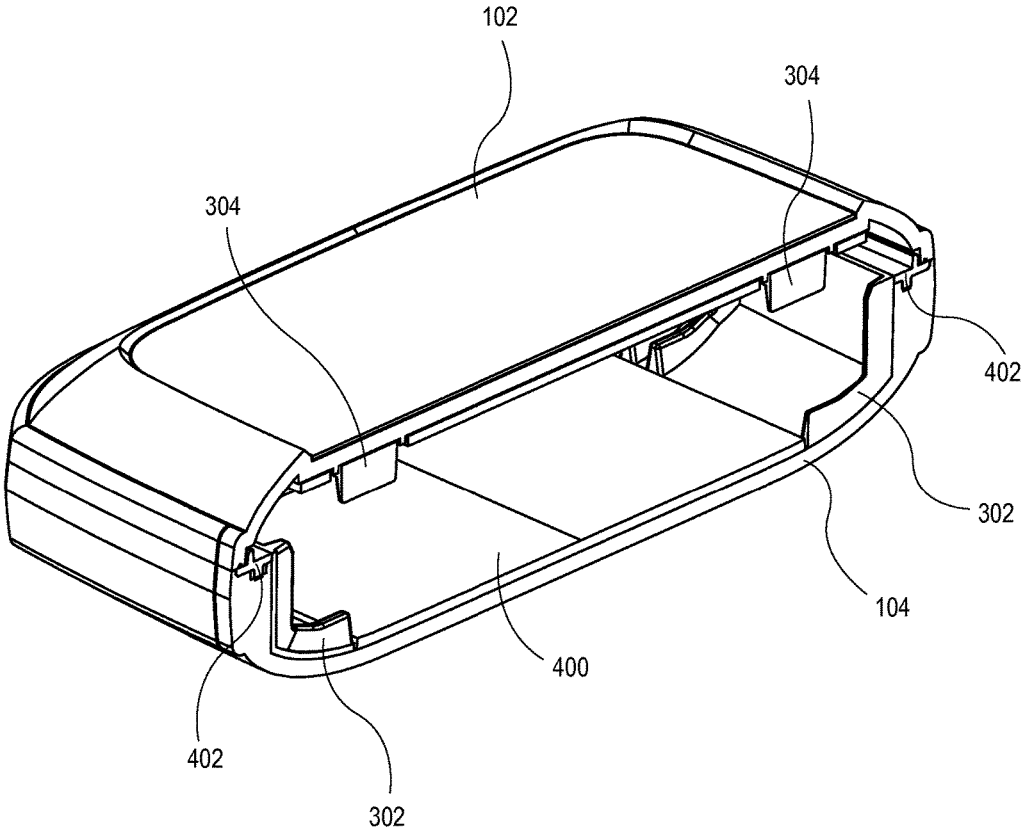
FIG. 5 shows a cutaway side view of the ruggedized enclosure of FIG. 1.

FIG. 5 shows a cutaway side view of the ruggedized enclosure of FIG. 1 in its closed configuration. As can be seen, the spacing cushions 304 and cushions 302 are located substantially along the same axis and closer to the edges of enclosure 100. In addition, a side view of portions of seal 402 is also shown.

Figure 6:
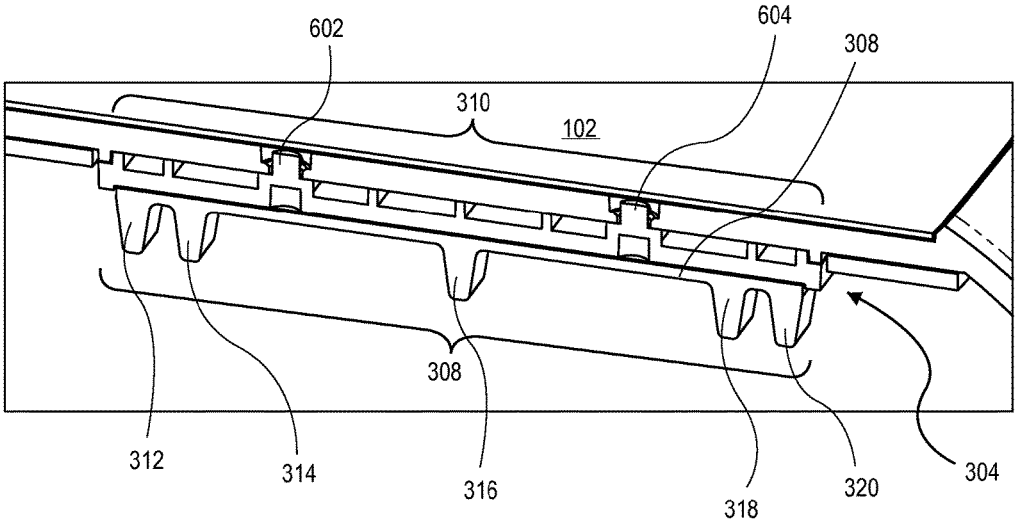
FIG. 6 shows a cutaway view of the cushion assembly of the ruggedized enclosure.

FIG. 6 shows a cutaway view of the cover 102 of the ruggedized enclosure and one of the cushioning assemblies 304. In particular, as shown, the cushioning assembly 304 may comprise a spacer 310 that can be attached or snapped into the cover and a cushion 308 having cushioning arms 312, 314, 316, 318, and 320.

The spacer 310 may be an optional component of the cushioning assembly 304. The spacer 310 may be constructed from various materials, such as a plastic, metal, etc. As shown, the spacer 310 may comprise clips 602 and 604 to allow it to be removably attached to the top 102. Of course, spacer 310 may be attached in other ways, such as via an adhesive, screw fastener, Velcro, etc. The spacer 310 may have different heights and shapes to accommodate different drives in the enclosure 100.

As shown, the cushioning arms 312, 314, 316, 318, and 320 may be a plurality of trapezoidal shaped ribs. The trapezoidal shape provided in the embodiments assists in optimizing buckling and compressive stiffness of the cushioning arms 312, 314, 316, 318, and 320. In addition, the trapezoidal base of arms 312, 314, 316, 318, and 320 prevent collapse or buckling of the rib during shock. The arms 312, 314, 316, 318, and 320 are placed to provide securement and are distributed to avoid contact with each other during shock. In alternative embodiments, the arms 312, 314, 316, 318, and 320 may be provided cross-beams or other type of structural aid to provide desired rigidity or to counteract buckling under excessive loading during shock conditions.

Furthermore, the cushion 308 may have different size, shape, and placement of the arms 312, 314, 316, 318, and 320 to accommodate different drive sizes and thicknesses. For example, the cushion 308 may be removable attached to the spacer 310 or cover 102, such as by an adhesive strip, Velcro, etc.

In other embodiments, the arms 312, 314, 316, 318, and 320 may be shaped differently, such as conical. In addition, the number and placement of ribs may be varied in the embodiments to achieve a desired shock protection or fitment to a particular device.

Figure 7:
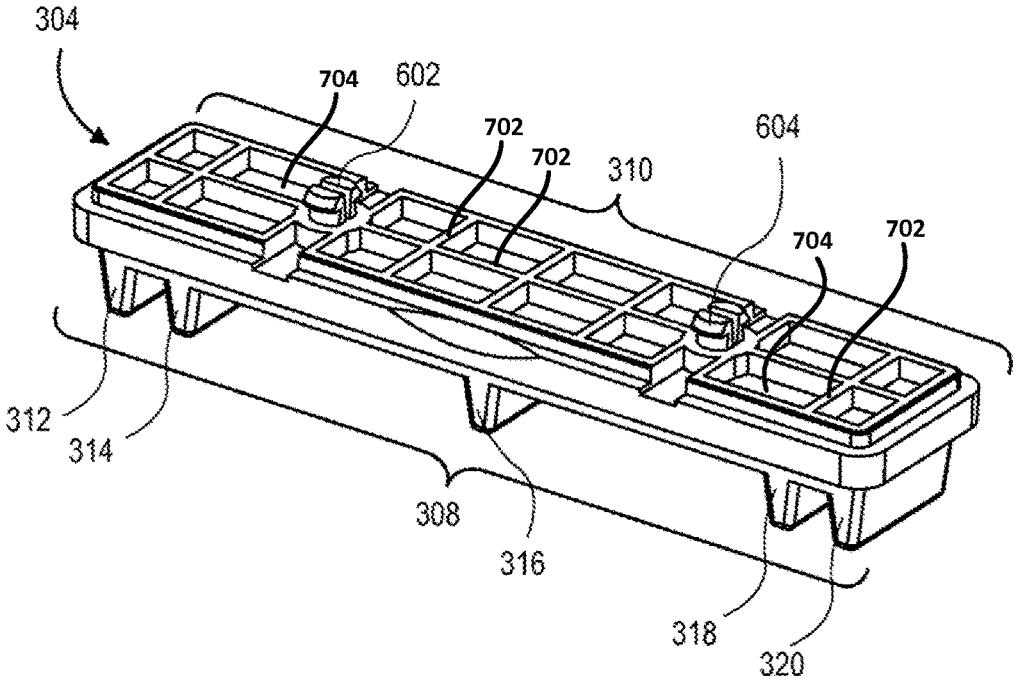
FIG. 7 shows an exemplary cushion assembly that may be provided in the ruggedized enclosure.
Figure 8:
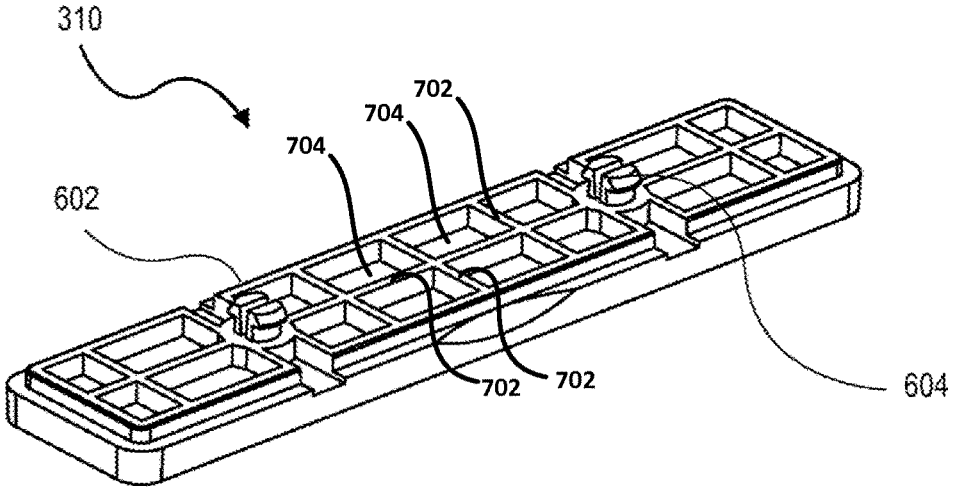
FIG. 8 shows another view of the spacer component of the cushion assembly that may be provided in the ruggedized enclosure.

FIG. 7 shows an exemplary spacer 310 of the cushion assembly 304 that may be provided in the ruggedized enclosure 100. As shown, the spacer 310 may comprise clips 602 and 604. As noted previously, these 602 and 604 allow the spacing cushion 304 to be replaceable and changeable in the ruggedized enclosure 100. In the embodiment shown, the clips 602 and 604 provide a (semi-permanent snap-fit) locking fit into corresponding holes in the top 102. Of course, spacer 310 may employ other types of retaining features, such as a snap-on fit or interference fit. For purposes of illustration, FIG. 8 is also provided to show a top elevation view of the spacer 310 and clips 602 and 604. The spacer 310 comprises a lattice of internal walls 702 that defines a plurality of voids 704, which may be rectangular in shape, as shown.

The features and attributes of the specific embodiments disclosed above may be combined in different ways to form additional embodiments, all of which fall within the scope of the present disclosure. Although the present disclosure provides certain embodiments and applications, other embodiments that are apparent to those of ordinary skill in the art, including embodiments, which do not provide all of the features and advantages set forth herein, are also within the scope of this disclosure. Accordingly, the scope of the present disclosure is intended to be defined only by reference to the appended claims.

What is claimed is:

1. An enclosure for an electronic device, comprising:
- a housing, comprising a top, a bottom and sides; and
- a modular cushion assembly configured to dampen shocks to the electronic device, the modular cushion assembly comprising:
  - a first spacer comprising a surface in contact with the top of the housing; and
  - a first cushion configured to be removably coupled to the first spacer, the first cushion comprising structures defining:
    - a side wall extending around a perimeter of the first cushion; and
    - a plurality of cushioning arms extending away from the side wall and away from the top of the housing, the cushioning arms each defining an electronic device contact surface at their free end furthest from the top of the housing,
    - wherein the side wall is integral to and configured to provide structural support to the plurality of cushioning arms.

2. The enclosure of claim 1, wherein at least one of the plurality of cushioning arms has a trapezoidal shape.

3. The enclosure of claim 1, wherein the first spacer is configured to be interference-fit to the top of the housing.

4. The enclosure of claim 1, wherein each of the plurality of cushioning arms extends across facing surfaces of the side wall.

5. The enclosure of claim 1, wherein the side wall extends at least one of around and within the perimeter of the cushion.

6. The enclosure of claim 1, wherein most of the plurality of cushioning arms are disposed closer to the sides of the housing than to a center thereof.

7. The enclosure of claim 1, wherein the plurality of cushioning arms are spaced apart from one another such that at least some are clustered closer to the sides of the housing than to a middle thereof.

8. The enclosure of claim 1, wherein each of a first and a second next adjacent cushioning arm of the plurality of cushioning arms comprises a first and a second major surface such that the first major surface of the first cushioning arm faces the second major surface of the second cushioning arm.

9. The enclosure of claim 8, wherein the first and second major surfaces of each of the first and second cushioning arms are straight, non-curved surfaces.

10. The enclosure of claim 8, wherein the first major surface of the first cushioning arm is not parallel to the facing second major surface of the second cushioning arm.

11. The enclosure of claim 1, further comprising a second spacer and a second cushion that is configured to be removably coupled to the second spacer and that comprises at least one side wall structure and cushioning arm structures that are similar to those of the first cushion, wherein the electronic device contact surface of one of the plurality cushioning arms of the first cushion is aligned with the electronic device contact surface of a corresponding one of the plurality of cushioning arms of the second cushion.

12. An enclosure for an electronic device, comprising:
a housing, comprising a top, a bottom and sides; and
a modular cushion assembly configured to dampen shocks to the electronic device, the modular cushion assembly comprising:
a spacer configured to be removably attached to the top of the housing; and
a cushion configured to be removably coupled to the spacer such that the cushion is further away from the top of the housing than is the spacer, the cushion comprising structures defining a side wall and a plurality of cushioning arms extending away from the side wall and away from the top of the housing,
wherein the spacer is configured to be interference-fit to the top of the housing.

13. The enclosure of claim 12, wherein the spacer comprises a clip configured to snap-fit to the top of the housing.

14. The enclosure of claim 12, wherein the spacer is configured to be attached to the top of the housing by a fastener.

15. The enclosure of claim 12, wherein the spacer comprises a retaining feature that is configured to attach the spacer to the top of the housing.

16. The enclosure of claim 15, wherein the cushion is configured to removably couple to the spacer with the retaining feature.

17. The enclosure of claim 12, wherein the spacer comprises a lattice of internal walls that defines a plurality of voids.

18. The enclosure of claim 12, wherein the spacer comprises a lattice of internal walls that defines a plurality of rectangular-shaped voids.

19. An enclosure for an electronic device, comprising:
a housing, comprising a top, a bottom and sides; and
a modular cushion assembly configured to dampen shocks to the electronic device, the modular cushion assembly comprising:
a spacer configured to be removably attached to the top of the housing; and
a cushion configured to be removably coupled to the spacer such that the cushion is further away from the top of the housing than is the spacer, the cushion comprising structures defining a side wall and a plurality of cushioning arms extending away from the side wall and away from the top of the housing,
wherein the spacer is configured to be snap-fit to the top of the housing.

20. The enclosure of claim 19, wherein the spacer is configured to be semi-permanently snap-fit to the top of the housing.

21. The enclosure of claim 19, wherein the side wall is integral to and configured to provide structural support to the plurality of cushioning arms.

* * * * *